United States Patent [19]

Hansen et al.

[11] Patent Number: 4,987,956

[45] Date of Patent: Jan. 29, 1991

[54] APPARATUS FOR USE IN DRILLING A WELL AT AN OFFSHORE LOCATION

[76] Inventors: Asger Hansen, 14655 Champion Forest Dr., #1703, Houston, Tex. 77069; Martin J. Kelly, Jr., 15622 T. C. Jester Blvd., Houston, Tex. 77068

[21] Appl. No.: 400,075

[22] Filed: Aug. 30, 1989

[51] Int. Cl.[5] ..... E21B 29/12

[52] U.S. Cl. ..... 166/361; 166/55; 166/340; 166/365; 285/308; 285/920

[58] Field of Search ..... 166/335, 338, 339, 340, 166/342, 344, 345, 346, 348, 349, 350, 351, 352, 359, 360, 361, 363-368, 377, 378, 380, 381, 383, 55, 55.2, 55.8; 285/140, 165, 302, 417, 418, 920, 922, 308, 315, 317, 320, 321, 18; 403/375-377; 405/191

[56] References Cited

U.S. PATENT DOCUMENTS

| | | | |
|---|---|---|---|
| 1,802,565 | 4/1931 | Lacey | 166/55 |
| 3,189,098 | 6/1965 | Haeber | 166/352 |
| 3,325,190 | 7/1967 | Eckert et al. | 285/18 |
| 3,326,579 | 7/1967 | Fowler | 285/308 |
| 3,332,484 | 7/1967 | Watkins | 166/6 |
| 3,492,027 | 1/1970 | Herring | 285/18 |
| 3,675,713 | 7/1972 | Watkins | 166/16 |
| 4,169,507 | 10/1979 | Szymczak | 166/340 |
| 4,222,591 | 9/1980 | Haley | 285/18 |
| 4,286,665 | 9/1981 | Walker | 166/339 |
| 4,323,117 | 4/1982 | Pierce | 166/55 |
| 4,397,357 | 8/1983 | Hettinger | 166/345 |
| 4,424,988 | 1/1984 | Cowx | 285/2 |
| 4,431,215 | 2/1984 | Moyer | 285/18 |
| 4,469,136 | 9/1984 | Watkins | 137/798 |
| 4,491,346 | 1/1985 | Walker | 285/18 |
| 4,531,585 | 7/1985 | Hansen | 166/297 |
| 4,611,661 | 9/1986 | Hed et al. | 166/339 |
| 4,651,830 | 3/1987 | Crotwell | 166/338 |
| 4,746,246 | 5/1988 | Cowan et al. | 405/191 |
| 4,761,023 | 8/1988 | Troxell | 285/18 |

*Primary Examiner*—Bruce M. Kisliuk

*Attorney, Agent, or Firm*—Vaden, Eickenroht, Thompson & Boulware

[57] ABSTRACT

Apparatus is disclosed for use in drilling an offshore well wherein a drill string suspended from a drill ship for extension within a riser pipe, lower marine riser package and subsea wellhead including a blowout preventer stack may be sheared at a location intermediate the lower end of the riser pipe and a flex or ball joint of the riser package.

11 Claims, 3 Drawing Sheets

FIG. 1
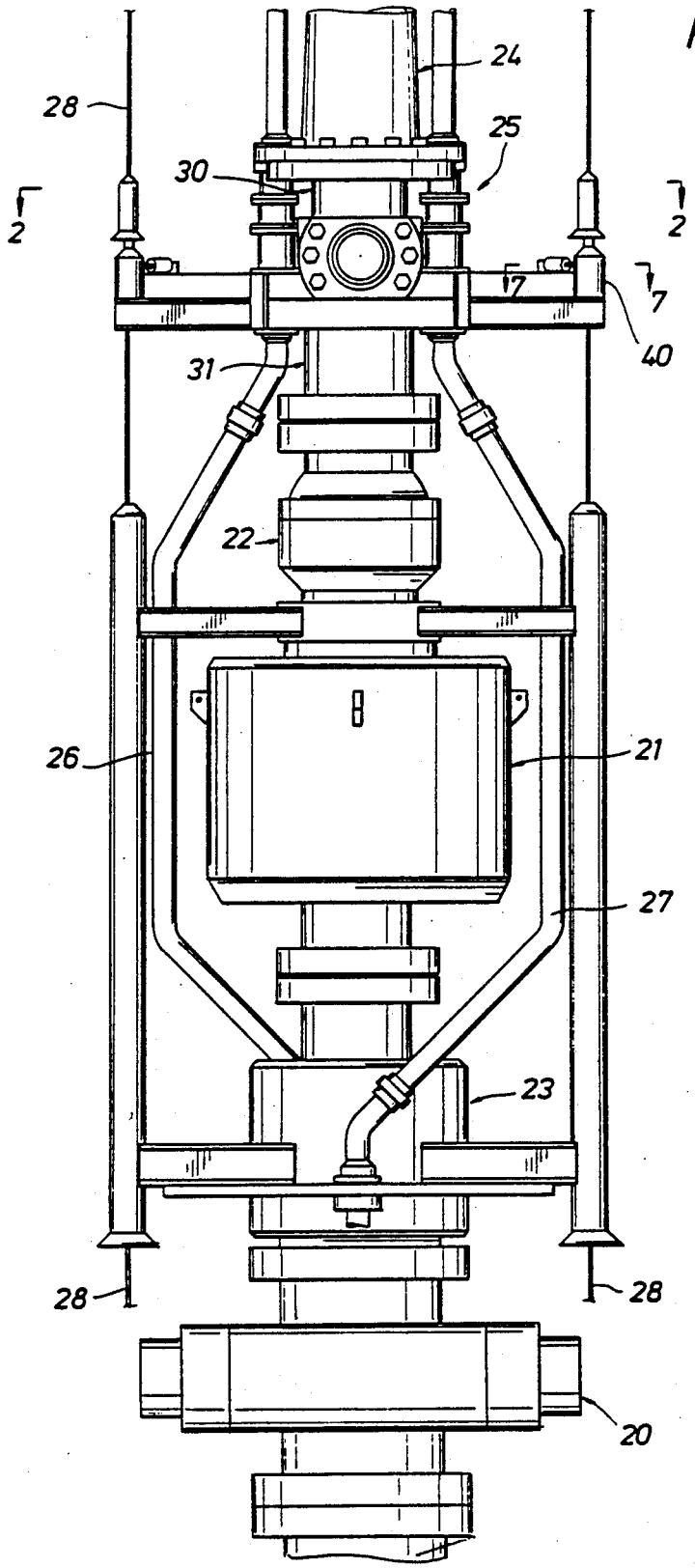
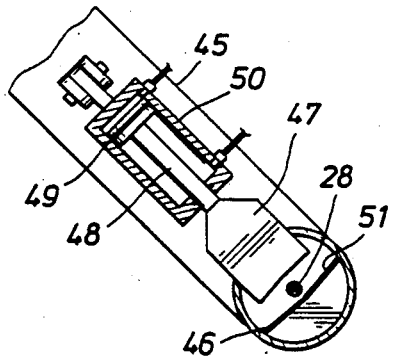
FIG. 7

APPARATUS FOR USE IN DRILLING A WELL AT AN OFFSHORE LOCATION

This invention relates generally to apparatus for use in drilling a well at an offshore location. More particularly, it relates to improvements in apparatus of this type in which the drill string is suspended from a floating vessel for extension into the well bore at the ocean floor and may be sheared to permit its sheared upper end to be retrieved with a riser pipe through which it extends in the event of an emergency such as a blowout of the well and/or the need to quickly remove the vessel from the area.

Thus, in the drilling of an offshore well from a floating vessel, a riser pipe extends between the vessel and a lower marine riser package (LMRP) for connecting the lower end of the riser to a blowout preventer stack and wellhead at the ocean floor. During the drilling of the well, the wellhead includes a ram type blowout preventer stack connected to the lower end of a wellhead connector at the lower end of the LMRP. The package may also include an annular type blowout preventer having a ball of flex joint connected to its upper end to which the lower end of the riser pipe is connected.

In the event of an emergency, "shear" rams in the ram type blowout preventer may be closed in order to shear the drill string. In addition to shearing the pipe, the rams seal with respect to one another and the housing or body of the blowout preventer to close off the well bore. The lower end of the wellhead connector is then released from the upper end of ram type preventer to permit removal of the LMRP and riser pipe along with the sheared upper end of the drill string.

This procedure presents several problems, including the necessity for raising the sheared upper end of the drill string from within the housing of the ram type preventer, and further in disconnecting the wellhead connector from the stack. Thus, such a connector conventionally comprises telescoping parts requiring lifting to disconnect. This is time consuming, and, in many cases, when the drill ship is a substantial distance off of a position above the wellhead, will damage the blowout preventer and in some cases cause it to be tilted.

An object of this invention is to provide apparatus in which the drill string may be sheared in such a manner as to permit retrieval of the sheared upper end of drill string without these and other problems inherent in present practices.

In the drilling of a well of this type, it is also standard procedure to guidably lower the preventer stack as well as the LMRP and riser pipe by means of sleeves which slide along guidelines extending from the drill ship to the base of the wellhead at the ocean floor. Such apparatus also conventionally includes choke and kill lines which extend along the side of the riser pipe and LMRP to connect with the stack.

It is a further object of this invention to provide such apparatus which also permits retrieval of portions of the guidelines and choke and kill lines along the upper sheared end of the drill string.

These and other objects are accomplished, in accordance with the illustrated and preferred embodiment of the invention by apparatus which includes means connecting the lower end of the riser pipe to the upper end of the LMRP, means on the connecting means for shearing the drill string extending through the riser pipe and package, and means for releasing the connecting means, following shearing of the drill string, so that the upper sheared end of the drill string may be retrieved along with the riser pipe.

Thus, the riser pipe need not be lifted in order to permit it to be easily and quickly removed with the riser pipe from the sheared lower end of the drill string. Also, of course, since the connecting means is above the ball joint in the LMRP, it may be tilted with the riser and the portion of the LMRP above the joint to further fascilitate retrieval in the event the drilling vessel has moved laterally of the drill site.

In the preferred and illustrated embodiment of the invention, the connecting means comprises an upper tubular riser pipe connected to the lower end of the riser pipe, a lower tubular member connectible to the upper end of the riser package and releasably connected in end-to-end relation to the upper member, and means mounted in the upper member for movement across the bore thereof to shear a drill string extending within the bore. More particularly, the faces of the ends of the first and second members being substantially coplanar, and locking means on the end of the first member is movable into and out of locking engagement with means on the end of the second member, whereby, upon shearing of the drill string and movement of the locking means on the end of the first member out of locking engagement with the locking means on the end of the second member to release the connection of the members, the end of the first member may be moved laterally of the end of the second member as the upper sheared end of the drill string is retrieved along with the riser pipe following shearing of the drill string.

In accordance with a further novel aspect of the invention, a means is provided on the members to form a continuation of the choke and kill lines on the riser pipe and LMRP, respectively, which means includes sleeves mounted on the upper member for reciprocation into and out of telescoping relation with respect to conduits in the lower member so as to fluidly connect the choke and kill lines on the riser pipe and LMRP when so telescoped. More particularly, remotely operable means are also provided for moving the sleeve out of the conduit in the lower member so as to permit the lower end of the upper member laterally of the upper end of the lower member as the members are disconnected following shearing of the drill string.

In accordance with still another novel aspect of the invention, sleeves are mounted on the upper tubular member for receiving the guidelines and thereby guidably lowering the connected members, and means are provided for movement across each sleeve so as to shear the guideline therein. More particularly, remotely operable means are provided for so moving each such guideline shear means as the drill string is sheared prior to disconnection of the members and raising of the choke and kill line connecting sleeves from within the conduits of the lower member.

In the illustrated embodiment of the invention, the means by which the upper and lower members are connected comprises openings formed in the end face of the lower member each having a groove thereabout, hollow rods reciprocable within openings formed in the end face of the upper member for moving their lower ends into and out of the openings in the lower member, and locking parts carried on the ends of the lower rods for radial movement into and out of the grooves when the ends are within the openings in the lower member. More particularly, a pin is reciprocable within each rod between a first position in which it forces the locking parts into the groove and a second position in which the locking parts are free to retract in order that the rod may move to be raised out of the opening, and remotely operable means are provided on the upper member for moving each rod into and out of the opening and moving the pin into and out of locking position when the rod is in the opening so as to disconnect the members and thus permit the upper member to be raised with the riser pipe upon shearing of the drill string and guidelines.

In the drawings, wherein like reference characters are used throughout to designate like parts:

FIG. 1 is an elevational view of an offshore well installation in which the lower end of a riser pipe is releasably connected to the upper end of a lower marine riser package installed above a blowout preventer stack by means of apparatus constructed in accordance with the present invention;

FIG. 7 is an enlarged cross-sectional view of one of the guideline sleeves of the apparatus and the means by which the guideline within the sleeve may be sheared.

Figure 2:
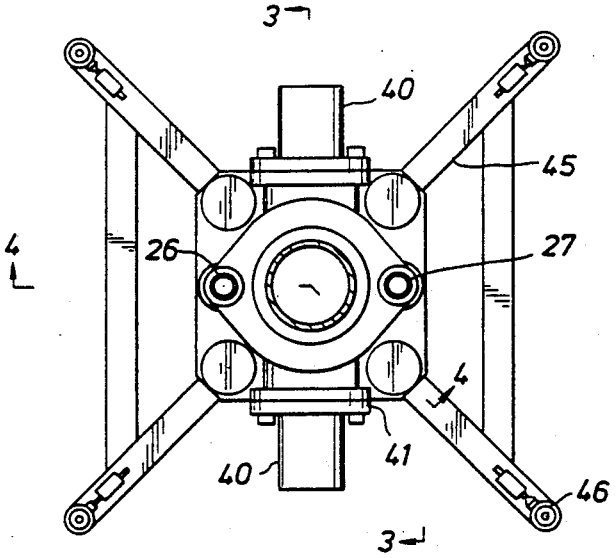
FIG. 2 is a cross-sectional view of the apparatus, as seen along broken lines 2—2 of FIG. 1.

With reference now to the details of the above described drawings, the well installation shown in FIG. 1 includes a blowout preventer stack having at least one ram type blowout preventer 20 mounted on a subsea wellhead (not shown) at the ocean floor, and a lower marine riser package including an annular type preventer 21 connected between a ball or flex joint 22 and a wellhead connector 23 for releasably connecting the lower end of the riser marine package to the upper end of the blowout preventer stack. The well installation further includes a riser pipe 24 which is suspended from a drilling vessel (not shown) at the surface and connected at its lower end to the upper end of the lower marine riser package by apparatus 25 constructed in accordance with the present invention for use in shearing a drill string DS (FIG. 3) which extends downwardly through the riser pipe, lower marine riser package and the blowout preventer stack into the well bore, and then disconnecting the riser pipe from the lower marine riser package so that it may be retrieved with the upper sheared end of the drill string.

The well installation also includes choke and kill lines 26 and 27, respectively, which extend downwardly from the drilling vessel and along the side of the riser pipe as well as the lower marine riser package for connection to the blowout preventer stack for a purpose well known in the art. The various parts of the well installation have been guidably lowered into place above the subsea wellhead by means of guidelines 28 anchored at their lower ends to the base of the wellhead and suspended from their upper ends from the drill vessel. Thus, sleeves or other parts on the components of the installation surround the guidelines for guiding the components into place during installation.

As previously described, in prior well installations of this type, the blowout preventer stack includes a ram type blowout preventer having shear rams for shearing the drill string in the event of an emergency. Upon shearing the pipe, it is also conventional practice to release the connector 23 from the stack to permit the lower marine riser package to be removed with the riser pipe thereabove from the upper end of the stack along with the upper sheared end of the drill pipe. This has not only required that a long length of the upper sheared end of the drill pipe be lifted from within the stack beneath the wellhead connector, but also that the wellhead connector itself be raised a substantial distance above the upper end of the stack in order to permit it to be removed therefrom.

As previously described, apparatus 25 instead permits the drill string to be sheared at a location intermediate the riser pipe and the lower riser marine package, and thus above the ball or flex joint which permits it to be tilted or angled with the riser pipe with respect to the vertical to accommodate lateral movement of the drilling vessel. In addition, and as also previously described, the releasable connection between the upper tubular member of the apparatus connected to the lower end of the riser pipe and the lower tubular member connected to the upper end of the lower marine riser package does not require that the upper member be raised to permit it to be removed from the upper sheared end of the drill string, and preferably is of such construction as to permit the upper member to be moved laterally off of the upper end of the lower member.

Figure 3:
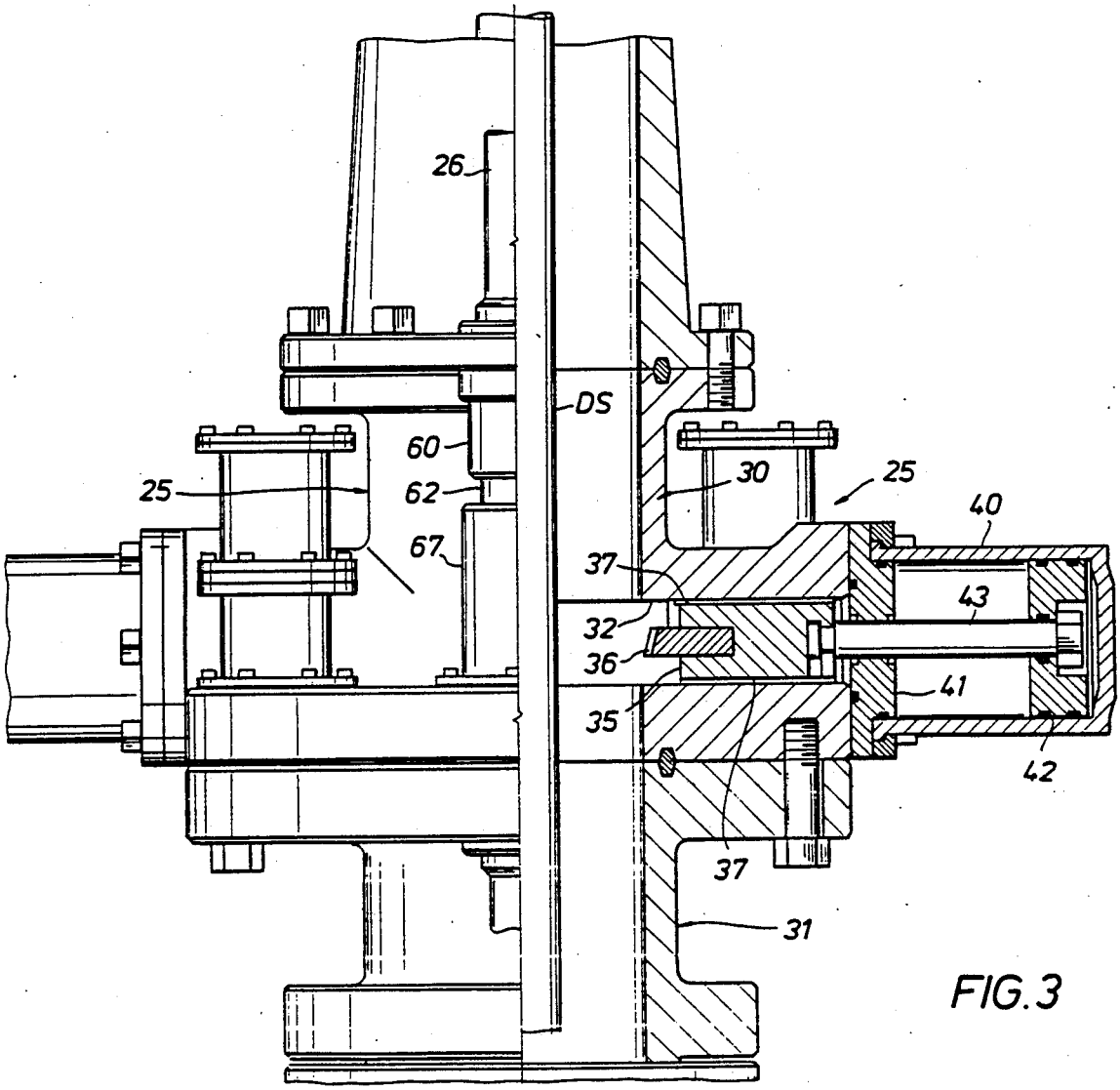
FIG. 3 is an enlarged view of the apparatus, partly in elevation and partly in section and as seen along broken lines 3—3 of FIG. 2.
Figure 4:
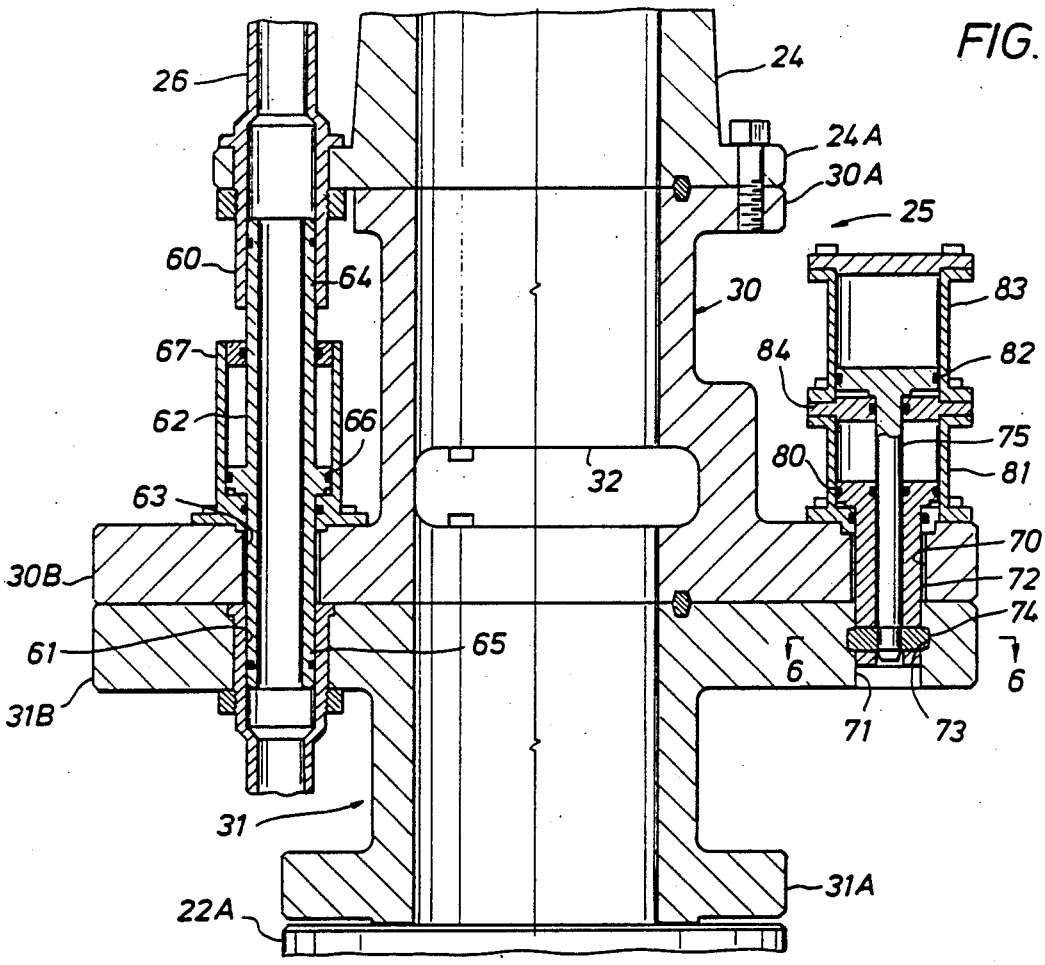
FIG. 4 is another enlarged sectional view of the apparatus, as seen along broken lines 4—4 of FIG. 2.

Thus, and as best shown in FIGS. 3 and 4, the shearing apparatus 25 comprises an upper tubular member 30 having a flange 30A at its upper end connected to a flange 24A on the lower end of riser pipe 24, and a lower tubular member 31 having a flange 31A on its lower end connected to a flange 22A on the upper end of flex or ball joint 22 of the lower marine riser package, whereby the bores through the upper and lower tubular members form continuations of the bores through the lower end of the riser pipe and upper end of the flex joint. More particularly, the upper and lower tubular members having flanges 30B and 31B which are releasably connected in end-to-end relation to one another and with their bores axially aligned to form smooth continuations of the riser pipe and flex joint. More particularly, the faces of the interconnected flanges on the ends of the upper and lower tubular members are essentially coplanar, and, as will be described, the means for connecting them is of such construction that, when they are disconnected, the lower end of the upper member may be moved laterally of the upper end of the lower member.

The upper member has a guideway 32 formed therein on each side of its bore near the lower end of the bore. Rams 35 having cutter blades 36 on their inner ends are reciprocable within the guideways between retracted positions, as shown in FIG. 3, and extended positions in which the blades move across the bore and past one another as to shear the drill pipe DS extending therein. Grooves 37 are formed in the upper and lower sides of the rams so as to bypass the rams when in closed, shearing position, thus permitting drill fluid in the upper sheared end of the drill string to be emptied therefrom.

Each ram is moved between its retracted and extended positions by means of an operator including a cylinder 40 having an inner wall 41 connected across the outer side of the upper tubular member to close the outer end of the guideway 32, and a piston 42 sealably slidable within the cylinder and having a rod 43 extending therefrom and through the wall 41 for releasable connection to the outer end of the ram 35.

As shown in FIGS. 1 and 2, arms 45 extend outwardly from the upper tubular member to support sleeves 46 on their outer ends in position to receive the guidelines 28. A means is also mounted on each arm for moving across the sleeve so as to shear the guideline, as the drill string DS is sheared, whereby their upper sheared upper ends may be retrieved along with the upper sheared end of the drill string. Thus, as best shown in FIG. 7, a shearing blade 47 is mounted on the inner end of a rod 48 connected to a piston 49 sealably reciprocable within a cylinder 50 mounted on the upper side of each arm 45, the rod 48 extending sealably through the inner end of the cylinder 50 for connecting the shear blade 47 to the piston.

As shown in FIG. 7, an abutment 51 is formed across the sleeve 46 near its midpoint and thus just behind the guideline 28 extending therethrough. This then permits the piston to be moved inwardly so as to move the inner cutting edge of the blade 47 against the abutment 51 in order to shear the guideline 28. Pressure fluid for actuating the pistons for operating the drill string shear rams as well as the shear blade may be supplied from the same source, which preferably is a source other than that provided for operating the preventers of the blowout preventer stack.

As shown in FIG. 4, the lower end of the choke line 26 extending along the side of riser pipe 24 has a lower tubular extension 60 which passes through the flange 24A on the lower end of the riser pipe. The portion of the kill line which extends along the side of the lower marine riser package is connected to a tubular extension carried by flange 31A of the lower tubular member so as to form a conduit 61 on the flange of the lower tubular member 31. A sleeve 62 carried by the upper tubular member extends through an opening 63 in the flange 30A and has an upper end 64 sealably slidable within the conduit 61 to fluidly connect the portions of the line extending along the sides of the riser pipe and LMRP.

The sleeve 62 is reciprocated between the lower position shown in FIG. 4, wherein its lower end 65 extends into the upper end of conduit 61, and an upper position in which its lower end is withdrawn from within the conduit and thus above the lower planar end of the flange 30B. For this purpose, the sleeve 62 has a piston 66 formed thereon which is sealably slidable within a cylinder 67 mounted on the flange 30B of the upper tubular member. Obviously, the upper and lower tubular members may be provided with similar means for fluidly connecting the lower end of the choke line on the lower end of the riser pipe with the upper end of the choke line on the upper end of the lower marine riser package.

Figure 5:
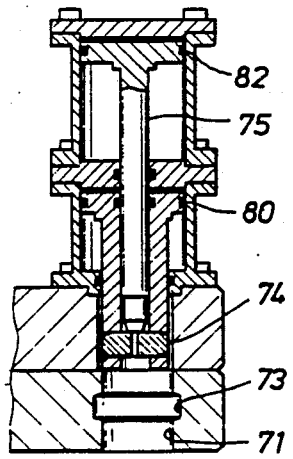
FIG. 5 is a vertical sectional view of the parts for releasably locking the upper and lower tubular members of the apparatus, as shown in FIG. 4, but with the locking parts on the upper member raised to releasing position.

As best shown in FIGS. 4 and 5, the upper and lower tubular members are releasably connected to one another by means which includes locking parts on the lower end of the upper tubular member and upper end of the lower tubular member. More particularly, the flange 30B of the upper member has an opening 70 formed therethrough which is aligned with an opening 71 formed through the upper flange 31B of the lower tubular member, and a rod 72 is mounted on the upper tubular member for reciprocation within the opening 70 between a lower position (FIG. 4) in which its lower end extends into the opening 71 and an upper position (FIG. 5) in which its lower end is above the opening 71 so as to release the upper member for movement laterally with respect to the lower tubular member, as previously described.

Figure 6:
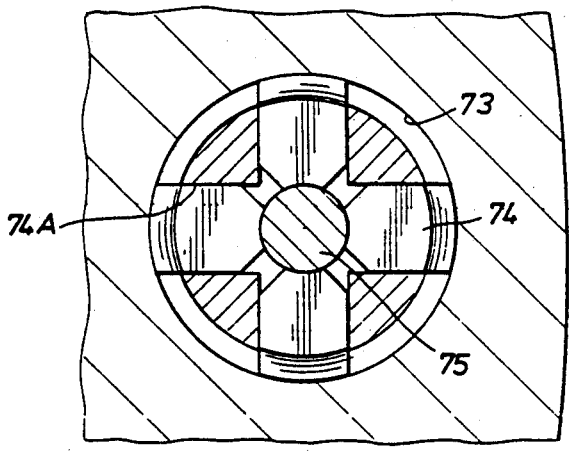
FIG. 6 is a further enlarged cross-sectional view of a portion of the locking parts, as seen along broken lines 6—6 of FIG. 4.

The opening 71 in the flange of the lower tubular member has a groove 73 formed thereabout and locking parts 74 which are best shown in FIG. 6 to be mounted on the lower end of the rod 72 for movement into and out of locking engagement within the groove 73 when the locking parts 74 are disposed opposite the groove. More particularly, the locking parts are adapted to be moved outwardly to locking position by means of the lower end of a pin 75 which extends through the rod and is vertically reciprocable with respect thereto between the lower locking position of FIG. 4 and an upper position wherein, as shown in FIG. 5, the lower end of the pin is removed from within the locking part 74 to permit them to be forced into retracted position as the rod is moved to its upper releasing position. Thus, as shown, the upper end of the groove 73 and the upper outer edges of the locking parts 74 are tapered to permit the locking parts to be wedged inwardly as they are lifted with the rod 72.

The rod 72 is moved between its upper and lower positions by means of a piston 80 on its upper end which is sealably slidable within a cylinder 81 bolted to the top side of the flange 30B. The pin 75, on the other hand, is moved between its upper and lower positions by means of a piston 82 on its upper end sealably reciprocable within a cylinder 83 mounted above the cylinder 81. As shown, a wall 84 separates the upper end of cylinder 81 from the lower end of cylinder 83 and has a hole through which rod 75 sealably extends.

The pistons are of course operated sequentially in order to move the locking means between locking and unlocking positions. Thus, for example, with the rod 72 and locking parts 74 in the locking position of FIG. 4, piston 82 is initially raised to remove the lower end of the pin 75 from within the locking part 74. At this time, the cylinder 80 may be moved upwardly to force the locking parts 74 inwardly out of the groove 73, to permit the rod 72 to be raised to the unlocking position of FIG. 5. Conversely, in order to releasably connect the upper member to the lower tubular member, rod 72 is first moved downwardly into the position of FIG. 4, following which the pin 75 is moved downwardly so as to insert its lower end within the inner sides of the locking part 74 and thus into the groove 73.

In any case, the means for operating the pistons 80 and 82 is coordinated with the means for operating the piston 66 so as to move the locking means to unlocking position as the sleeve 62 is raised from within the upper end of the choke or kill line in which it is disposed. Prior to actuation of the pistons, of course, the rams 35 have been moved inwardly to shear the drill string and the shear blades 47 have been moved to shear the guidelines 28.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. Apparatus for use in drilling a well at an offshore location, comprising an upper tubular member, a lower tubular member, means for releasably connecting the upper and lower members in end-to-end relation, and means mounted in the upper member for movement across the bore thereof to shear a drill string extending within the bore, the faces of the ends of the upper and lower members being substantially coplanar, and the connecting means comprises means extendable from the end face of the upper member into and out of locking engagement with means in the end face of the lower member, whereby, upon shearing of the drill string and movement of the extendable locking means on the end face of the upper member out of locking engagement with the locking means in the end face of the lower member to release the connection of the members, the end face of the upper member may be moved laterally of the end face of the lower member as the upper sheared end of the drill string is retrieved, and remotely operable means for moving the shear means across the bore of the upper member and then moving the locking means on the end face of the upper member out of locking engagement with the locking means in the end face of the lower member.

2. Apparatus for use in drilling a well at an offshore location, comprising an upper tubular member, a lower tubular member, means for releasably connecting the upper and lower members in end-to-end relation with their bores aligned, and means mounted in the upper member for movement across the bore thereof to shear a drill string extending within the bore, the faces of the ends of the upper and lower members being substantially coplanar, the connecting means comprising means extendable from the end of the upper member into and out of locking engagement with means in the end face of the lower member, and means on the upper and lower members adapted to form continuations of choke and kill lines on a riser pipe and riser package, respectively, including sleeves mounted on the upper member for reciprocation into and out of telescoping relation within conduits on the lower member, whereby, upon shearing of the drill string and movement of the extendable locking means on the end of the upper member out of locking engagement with the locking means in the upper end face of the lower member to release the connection of the members, and withdrawal of the sleeves from the conduits of the lower member, the end face of the lower member may be moved laterally of the end face of the lower member as the upper sheared end of the drill string is retrieved following shearing of the drill string, and remotely operable means for moving the shear means across the bore of the upper member and then moving the locking means on the end face of the upper member out of locking engagement with the locking means in the end face of the lower member and the sleeves out of telescoping position with the conduits of the lower member.

3. Apparatus for use in drilling a well at an offshore location comprising an upper tubular member, a lower tubular member, means for releasably connecting the upper and lower members in end-to-end relation and with their bores aligned, and sleeves on the upper member for surrounding guidelines, means mounted in the upper member for movement across the bore thereof to shear a drill string extending within the bore, means mounted on the upper member for movement across each sleeve to shear the guideline therein, the faces of the ends of the upper and lower members being substantially coplanar, and the connecting means comprises means extendable from the end face of the upper member for movement into and out of locking engagement with means in the end face of the lower member, whereby, upon shearing of the drill string and guidelines and movement of the locking means on the end face of the upper member out of locking engagement with the locking means in the end face of the lower member to release the connection of the members, the end face of the upper member may be moved laterally of the end face of the lower member as the upper sheared ends of the drill string and guidelines are retrieved following shearing of the drill string and guidelines, and remotely operable means for moving the shear means across the bores of the upper member and each sleeve and then moving the locking means on the end of the upper member out of locking engagement with the locking means in the end of the lower member.

4. Apparatus for use in drilling a well at an offshore location, comprising an upper tubular member, a lower tubular member, means for connecting the upper and lower members in end-to-end relation and with their bores aligned, and means mounted in the upper member for reciprocation across the bore thereof to shear a drill string extending within the bores of the connected members, the faces of the ends of the upper and lower members being substantially coplanar, the connecting means comprising openings formed in the end face of the lower member each having a groove thereabout, hollow rods reciprocable within openings formed in the end face of the upper member for moving their lower ends into and out of the openings in the lower member, locking parts carried on the lower ends of the rods for radial movement into and out of the grooves when the ends are within the openings in the lower member, and a pin reciprocable within each rod between a first position in which it forces the locking parts into the groove and a second position in which the locking parts are free to retract in order that the rod may be raised out of the opening, remotely operable means on the upper member for moving each rod into and out of the opening and moving the pin into and out of locking position when the rod is in the opening, and remotely operable means on the upper member for moving the shear means across the bore of the upper member, whereby, upon movement of the rods out of the openings in the lower member, the face of the end of the upper member may be moved laterally off the face on the lower member to permit it to be retrieved with the upper end of the sheared drill string.

5. Apparatus of the character defined in claim 4, including sleeves on the upper member for receiving guidelines, and means on the upper member for moving across each sleeve to shear the guideline therein, and remotely operable means on the upper member for so moving each shear means.

6. Apparatus of the character defined in claim 4, including a sleeve mounted on the upper member for reciprocation into and out of telescoping relation with respect to conduits on the lower member for forming continuations of choke and kill lines, and remotely operable means on the upper member for so moving each sleeve.

7. Apparatus of the character defined in claim 5, including conduits formed in each of the upper and lower members connectable to choke and kill lines, a sleeve reciprocable within each conduit of the upper member into and out of telescoping relation with a conduit of the lower member for fluidly connecting them, and remotely operable means on the upper member for so moving each sleeve.

8. Apparatus of the character defined in claim 4, including means including grooves in their upper and lower sides bypassing the shear means to fluidly connect the bores of the members following movement of the shear means to shear the drill string.

9. In apparatus for drilling a well at an offshore location wherein a riser pipe suspended from a drilling vessel is connected by a lower marine riser package to a subsea wellhead assembly which includes a blowout preventer stack at the ocean floor, the improvement which comprises an upper tubular member connected to the lower end of the riser pipe, a lower tubular member connected to the lower marine riser package, and means releasably connecting the member in end-to-end relation, means in the upper member for shearing a drill string extending through the riser pipe and package, the faces of the ends of the upper and lower members being substantially coplanar, and the connecting means comprises means extendable from the end face of the upper member movable into and out of locking engagement with means in the end face of the lower member, whereby, upon shearing of the drill string and movement of the extendable locking means on the end of the upper member out of locking engagement with the locking means in the end face of the lower member to release the connection of the members, the end face of the upper member may be moved laterally of the end face of the lower member as the upper sheared end of the drill string is retrieved, and remotely operable means for moving the shear means across the bore of the upper member and then moving the locking means on the end face of the upper member out of locking engagement with the locking means in the end face of the lower member.

10. In apparatus of the character defined in claim 9, which also includes choke and kill lines suspended from the vessel and extending along the riser pipe and package to connect at their lower ends to the stack, the further improvement comprising means on the members for fluidly connecting the choke and kill lines extending along the riser pipe and package, and movable to a position permitting the choke and kill lines extending along the riser pipe to be retrieved with the riser pipe.

11. In apparatus of the character defined in claim 9 which also includes sleeves on the riser pipe, riser package and wellhead assembly which receive guidelines extending from the vessel to the base of the assembly, the further improvement comprising means on the upper member for shearing the guidelines so as to permit the upper sheared ends thereof to be retrieved with the upper sheared end of the drill string.

* * * * *